United States Patent [19]

Pomerantz

[11] 4,245,603

[45] Jan. 20, 1981

[54] ADAPTIVE VEHICLE ENGINE CLOSED LOOP AIR AND FUEL MIXTURE CONTROLLER

[75] Inventor: Allen J. Pomerantz, Bancroft, Mich.

[73] Assignee: General Motors Corporation, Detroit, Mich.

[21] Appl. No.: 34,852

[22] Filed: Apr. 30, 1979

[51] Int. Cl.[3] ..... F02B 33/00

[52] U.S. Cl. ..... 123/440; 123/437

[58] Field of Search ..... 123/119 EC, 32 EE, 32 EA; 60/276, 285

[56] References Cited

U.S. PATENT DOCUMENTS

| | | | |
|---|---|---|---|
| 3,906,910 | 9/1975 | Szlago, Jr. | 123/119 EC |
| 3,973,529 | 8/1976 | Wessel et al. | 60/276 |
| 4,030,394 | 8/1977 | Wahl et al. | 123/119 EC |
| 4,057,042 | 11/1977 | Aono | 123/119 EC |
| 4,136,645 | 6/1979 | Ito et al. | 123/119 EC |
| 4,138,979 | 2/1979 | Taplin | 123/119 EC |
| 4,173,956 | 11/1979 | Ikeura et al. | 123/119 EC |

*Primary Examiner*—Charles J. Myhre
*Assistant Examiner*—R. A. Nelli
*Attorney, Agent, or Firm*—Howard N. Conkey

[57] ABSTRACT

A closed loop air and fuel ratio controller is responsive to the oxidizing/reducing conditions in the exhaust gases from an internal combustion engine to provide a control signal having a value for adjusting both the idle and main fuel metering circuits of a carburetor so as to supply an air and fuel mixture to the engine at a predetermined ratio. Two memory elements are provided, each being associated with a respective one of the idle and main fuel metering circuit for storing a value of the control signal provided by the controller. During operation of each of the idle and main fuel metering circuits, the value of the control signal stored by the respective one of the storage elements is updated in accord with the average value of the control signal provided by the controller. When the carburetor shifts operation from one of the fuel metering circuits to the other, the control signal provided by the controller is preset to the average value stored in the respective storage element, which value produced the desired oxidizing/reducing condition during prior engine operation in the respective fuel metering circuit. The adjustment of the value of the signals stored by the storage elements is inhibited during the conditions of engine speed which are representative of conditions wherein the oxidizing/reducing conditions in the exhaust gases do not accurately represent the actual air/fuel ratio of the mixture supplied by the respective idle and main fuel metering circuits.

2 Claims, 2 Drawing Figures

ADAPTIVE VEHICLE ENGINE CLOSED LOOP AIR AND FUEL MIXTURE CONTROLLER

Figure 1:
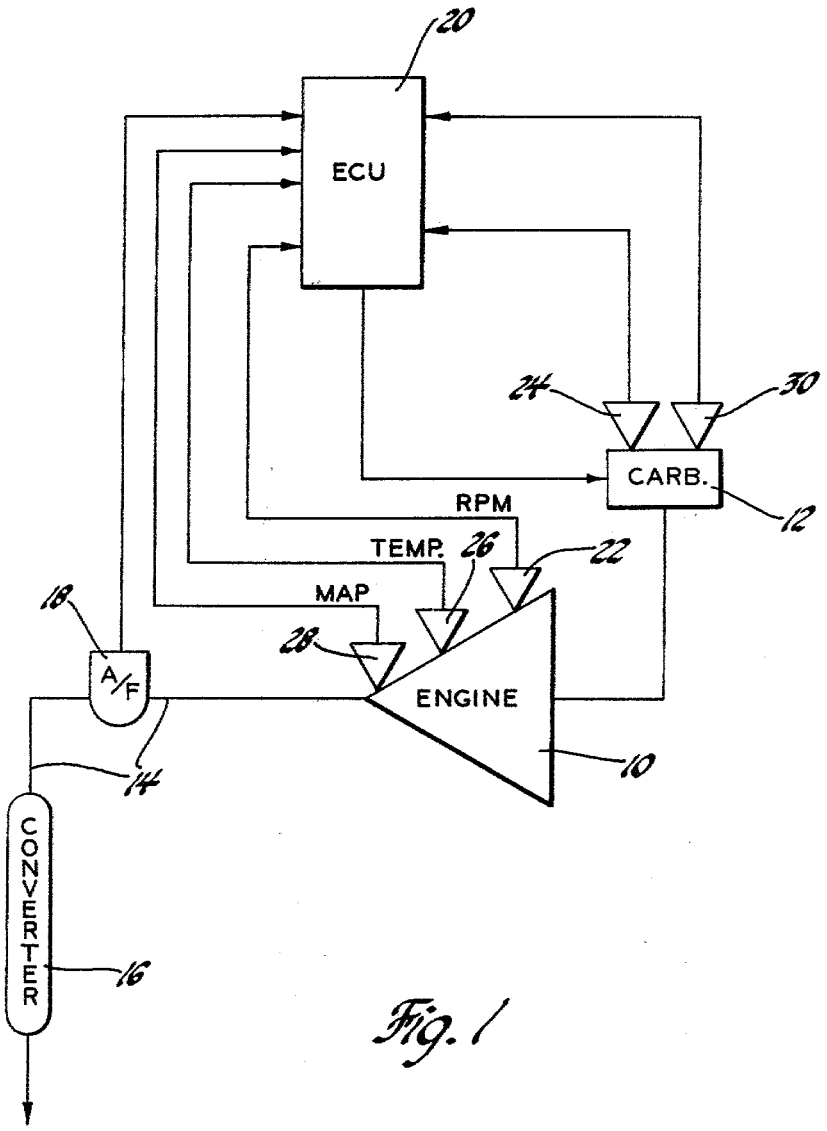

This invention is directed to a closed loop air and fuel mixture control system for an engine. More specifically, this invention is directed toward a controller for controlling the air/fuel ratio of a mixture suppled to an engine by a carburetor having separate idle and main fuel metering circuits.

A single catalytic device may be utilized to accomplish both the oxidation and reduction necessary for minimizing the undesirable exhaust components from an internal combustion engine provided that the air/fuel mixture supplied to the engine is maintained within a narrow band near the stoichiometric value. A closed loop controller is generally employed to maintain the mixture of the gases supplied to the converter within this narrow band. The most common forms of these closed loop systems respond to a sensor that is responsive to the oxidizing/reducing conditions in the exhaust gases and provide a control signal comprised of integral or integral plus proportional terms for adjusting the air/fuel ratio of the mixture supplied to the engine. This signal may function, for example, to trim the injection pulse width in a fuel injection system or to adjust fuel regulating elements of a carburetor in order to obtain the desired air/fuel ratio.

Generally, the carburetors employed in supplying an air and fuel mixture to an engine have separate idle and main fuel metering circuits operable respectively during idle and off-idle engine operating modes to supply the air/fuel mixture. Each of the fuel metering circuits is generally calibrated to provide a specified air/fuel ratio in response to the fuel and air determining parameters. However, for various reasons including manufacturing tolerances, it is difficult to provide for matched idle and main fuel metering circuits. Consequently, the air/fuel ratio of the mixture supplied by the two circuits may be offset from one another resulting in a substantially instantaneous shift in the ratio of the air and fuel mixture supplied by the carburetor when the engine operating mode shifts between idle and off-idle.

Due to the time delays of the system including the engine transport delay and the time response of the closed loop controller, a time period is required in order for the controller to adjust for the shift in the air/fuel ratio of the mixture supplied by the carburetor after the carburetor operation shifts between its fuel metering circuits. During this time period, the ratio of the mixture supplied to the engine is offset from the desired ratio at which the desired converter conversion efficiency exists resulting in an increase in the emissions of at least one of the undesirable exhaust gas constituents.

One system proposed to eliminate this offset air/fuel ratio includes a pair of memories each being associated with one of the idle and main fuel metering circuits, respectively. Each memory stores a value of the closed loop control signal which is adjusted to the average value of the closed loop control signal during operation of the respective fuel metering circuit. When the carburetor operation shifts between the idle and main fuel metering circuits, the controller output signal is initialized to the control signal value stored by the memory associated with the operating fuel metering circuit to provide an instantaneous adjustment of the closed loop controller output signal to correct for the air/fuel ratio offset between the idle and main fuel metering circuits.

In these systems, however, the stored value of the closed loop control signal may be updated during certain transient operating conditions of the engine where the sensed oxidizing/reducing conditions are not indicative of the actual air/fuel ratio of the mixture supplied by the fuel metering circuits. For example, when the carburetor throttle is moved to a closed position while the engine rpm is at a high level, the sudden vaporization of fuel from the manifold and carburetor walls may result in a sensed air/fuel ratio that is richer than stoichiometry even though the air/fuel ratio supplied by the carburetor may be substantially at a stoichiometric mixture. If the resulting closed loop control signal is utilized to update the stored value associated with the idle fuel metering circuit, the stored value may not be indicative of the control signal value required to obtain a stoichiometric mixture. When this stored signal is subsequently utilized to preset the closed loop control signal upon a shift in carburetor operation from the main to the idle fuel metering circuit the aforementioned air/fuel ratio offset may not be compensated for.

It is the general object of this invention to provide for an improved closed loop air/fuel ratio controller for controlling a carburetor having independent fuel metering circuits.

It is another object of this invention to provide for an internal combustion engine closed loop air/fuel ratio controller responsive to a sensed air/fuel ratio for controlling two independent fuel metering circuits of a carburetor wherein a memory is provided for each fuel metering circuit having a value stored thereat which is used to preset the controller output when the operation shifts to the corresponding fuel metering circuit and wherein the memory is updated during operation of the corresponding fuel metering circuit in accord with the controller output signal only during engine operating conditions where the sensed air/fuel ratio is representative of the air/fuel ratio of the mixture supplied by the fuel metering circuit.

It is another object of this invention to provide an internal combustion engine closed loop air/fuel ratio controller as set forth in the foregoing objects and wherein the fuel metering circuits include idle and main fuel metering circuits of a carburetor and wherein the memory associated with the idle fuel metering circuit is updated only during operation of the idle fuel metering circuit and when the engine speed is below a predetermined value and the memory associated with the main fuel metering circuit is updated only during operation of the main fuel metering circuit and when the engine speed is greater than the predetermined value so that the memory values are indicative of the air/fuel ratio of the mixture provided by the respective fuel metering circuits.

Figure 2:
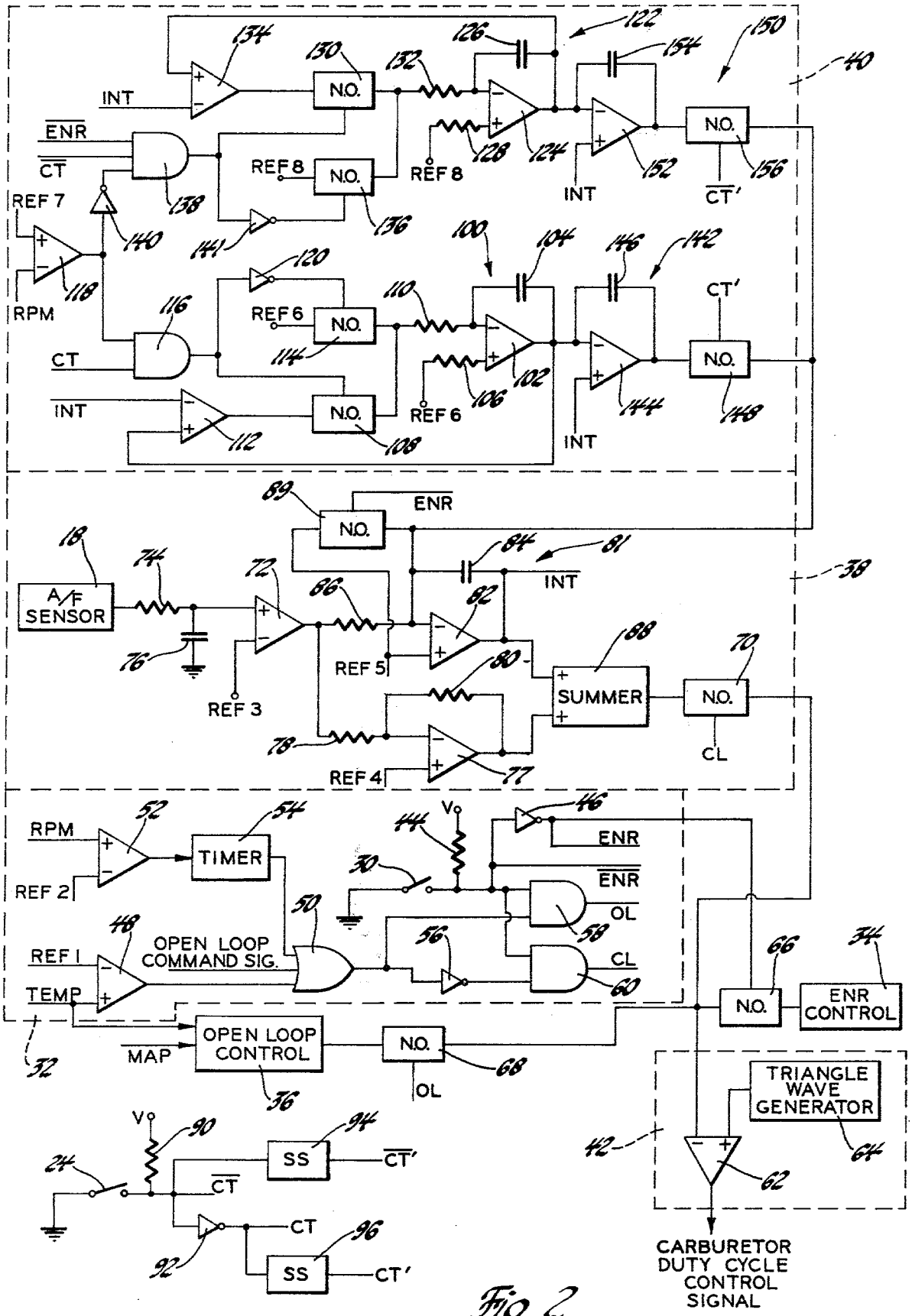

The invention may be best understood by reference to the following description of a preferred embodiment and the drawings in which:

FIG. 1 is a block diagram of the components of an internal combustion engine closed loop control system employing the principles of this invention; and FIG. 2 is a schematic diagram of the electronic control unit of FIG. 1 for controlling the air/fuel ratio of the mixture supplied by the carburetor in accord with the principles of this invention Referring to FIG. 1, an internal combustion engine 10 is supplied with a controlled mixture of fuel and air by a carburetor 12. This mixture is drawn into the respective cylinders of the engine 10 and burned. The combustion byproducts from the engine 10 are exhausted to the atmosphere through an exhaust conduit 14 which includes a catalytic converter 16.

The catalytic converter 16 is of the three-way type wherein carbon monoxide, hydrocarbons and nitrogen oxides can be simultaneously converted if the air/fuel mixture supplied thereto is maintained within a narrow band at stoichiometry. If the air/fuel ratio deviates from the narrow band at stoichiometry, the converter conversion efficiency of at least one of the undesirable exhaust constituents decreases.

The carburetor 12 is of the conventional type which includes an idle fuel metering circuit and a main fuel metering circuit, each of which is independently operable to supply an air/fuel mixture during the idle and off-idle operating modes, respectively, of the engine 10. However, it is difficult to provide a carburetor which has the desired response to the fuel determining input parameters over the full range of engine operating conditions. Additionally, these systems are generally incapable of compensating for various ambient conditions and fuel variations, particularly to the degree required in order to maintain the air/fuel mixture within the required narrow range at stoichiometry. Consequently, the air/fuel ratio provided by the carburetor 12 in response to its fuel determining input parameters may deviate from stoichiometry during engine operation. Further, it is difficult to calibrate each of the independent fuel metering circuits (idle and main) so as to provide a mixture having the same air/fuel ratio during engine idle and off-idle operation. Typically, the air/fuel ratio of the mixture supplied to the engine 10 by the idle fuel metering circuit is offset from the air/fuel ratio of the mixture supplied to the engine 10 by the main fuel metering circuit. This effectively results in a shift or disturbance in the air/fuel ratio of the mixture as the carburetor operation shifts between its idle and main metering circuits with the amount and direction of the air/fuel ratio shift being dependent upon the characteristics of each of the fuel metering circuits.

To provide for the control of the air/fuel ratio of the mixture supplied by the carburetor 12 to to engine 10 so as to obtain the desired converter conversion characteristics over all of the engine operating conditions, an A/F ratio sensor 18 is provided for sensing the oxidizing/reducing condition of the exhaust gases upstream from the catalytic converter 16. The sensor 18 is preferably of the zirconia type which, when exposed to engine exhaust gases at high temperatures, generates an output voltage which changes abruptly as the air/fuel ratio of the exhaust gases passes through the stoichiometric ratio. The output voltage is at a high value when the sensor 18 is exposed to rich air/fuel mixtures and is at a low value when the sensor 18 is exposed to lean air/fuel mixtues.

The output of the sensor 18 is coupled to the input of an electronic control unit 20 which generates a control signal that is supplied to an air/fuel ratio regulating element in the carburetor 12. The control signal varies in amount and sense tending to restore the air/fuel ratio of the mixture supplied to the engine 10 by the carburetor 12 to the desired air/fuel ratio.

The air/fuel ratio regulating element in the carburetor 12 is responsive to the control signal output of the electronic control unit 20 to adjust the air/fuel ratio of the mixture supplied by each of the idle and main fuel metering circuits. During closed loop control operation, the electronic control unit 20 is responsive to the output of an engine speed sensor 22 supplying a speed signal rpm and a closed throttle switch 24 on the carburetor 12 to provide for an adaptive adjustment of the closed loop control signal applied to the carburetor 12 in accord with the principles of this invention so as to compensate for the air/fuel ratio offset between the idle and main fuel metering circuits.

The electronic control unit 20 further includes open loop and power enrichment operating modes for controlling the air/fuel ratio supplied by the carburetor 12. During the period when the air/fuel sensor 18 is cold and during cold operation of the engine 10 when an air/fuel ratio other than stoichiometry is desired, the electronic control unit 20 adjusts the ratio of the mixture supplied by the carburetor 12 on an open loop basis. The amount of open loop adjustment of the carburetor 12 is provided in response to a coolant temperature signal provided by a temperature sensor 26 and manifold absolute pressure provided by a pressure sensor 28. The electronic control unit 20 provides for power enrichment in response to a wide open throttle switch 30. In response to a sensed wide open throttle conditions, the electronic control unit 20 supplies a power enrichment signal to the carburetor 12 to provide for an enriched mixture.

Referring to FIG. 2, the electronic control unit 20 of FIG. 1 is basically comprised of a mode control circuit 32, a power enrichment control circuit 34, an open loop control circuit 36, a closed loop control circuit 38, and an adaptive control circuit 40 that memorizes the average value of the output of the closed loop control circuit 38 during operation of each of the idle and main fuel metering circuits of the carburetor 12 in accord with the principles of this invention and presets the value of the output of the closed loop control circuit 38 when the operation of the carburetor 12 shifts between the idle and main fuel metering circuits to the appropriate memorized values so as to immediately compensate for an air/fuel ratio offset between the idle and main fuel metering circuits independent of the time delays associated with the engine transport delay and the closed loop circuit 38. A duty cycle oscillator 42 converts the outputs of the power enrichment control circuit 34, the open loop control circuit 36 and the closed loop control circuit 38 into a pulse width modulated constant frequency signal for controlling the carburetor idle and main fuel metering circuits.

The mode control circuit 32 commands the electronic control unit 20 to enter a power enrichment mode when the normally open wide open throttle switch 30 is closed in response to the throttle being positioned at a wide open position. This is accomplished by means of a series circuit including the wide open throttle switch 30 and a resistor 44 coupled between ground and a voltage source V. When the wide open throttle switch 30 is closed, a ground signal (hereinafter referred to as logic 0) is applied to the input of an inverter 46 whose output is a high signal (hereinafter referred to as logic 1) which comprises an enrichment signal ENR. When the wide open throttle switch 30 is open in response to the throttle being partially closed, a logic 1 signal $\overline{\text{ENR}}$ is applied to the input of the inverter 46 to terminate the enrichment signal ENR.

The mode control circuit 32 commands the electronic control unit 20 to enter an open loop mode in response to predetermined parameters indicative of desired open loop operation. When none of the open loop mode parameters exist, the mode control circuit 32 commands the electronic control unit 20 to operate in the closed loop mode. In this embodiment, it will be assumed that it is desired to provide for open loop control of the carburetor 12 when the engine coolant temperature is below a predetermined value and for a predetermined time period after the engine 10 is first started. In this respect, the engine temperature TEMP from the temperature sensor 26 is applied to the positive input of a comparator switch 48 which receives a voltage signal REF1 representing the predetermined temperature. When the temperature signal, which is inversely related to coolant temperature, is indicative of a coolant temperature below the temperature represented by the signal REF1, the output of the comparator switch 48 is a logic 1 signal that is applied to an input of an OR gate 50. Additionally, the engine speed signal RPM is applied to the positive input of a comparator switch 52 where it is compared with a voltage REF2 representing an engine speed greater than the cranking speed of the engine but less than the idle speed. When the engine has started, the output of the comparator switch 52, which is a logic 0 level before the engine starts, shifts to a logic 1 level to energize a timer 54 whose output shifts to a logic 1 level for a timed duration during which open loop operation is desired. The output of the timer 54 is applied to a second input of the OR gate 50.

Additional open loop command signals may also be applied to inputs of the OR gate 50 to provide for open loop operation. For example, a logic 1 signal may be applied to an additional input of the OR gate 50 when the air/fuel ratio sensor 18 impedance is high.

The output of the OR gate 50 is a logic 1 level when any one of the conditions exist for setting the electronic control unit 20 to the open loop operating mode. When the output of the OR gate 50 is a logic 0 level, the conditions exist for setting the electronic control unit 20 to the closed loop operating mode. The output of the OR gate 50 is applied to the input of an inverter 56 whose output is a logic 1 level when the conditions exist for closed loop operation of the electronic control unit 20.

The open loop and closed loop modes are inhibited during the period that the power enrichment mode is commanded. This is accomplished by an AND gate 58 which provides an open loop mode command signal OL only while the signal $\overline{\text{ENR}}$ is generated and an AND gate 60 which provides a closed loop mode command signal CL only while the signal $\overline{\text{ENR}}$ is generated.

The duty cycle oscillator 42 includes a comparator switch 62 and a triangular wave generator 64. The output of the triangular wave generator 64 is coupled to the positive input of the comparator switch 62 and the signal outputs of the enrichment control circuit 34, the open loop control circuit 36 and the closed loop control circuit 38 is coupled to the negative input of the comparator switch 62. The output of the comparator switch 62 is a pulse width modulated signal at the frequency of the triangular wave output of the triangular wave generator 64 having a duty cycle that is inversely proportional to the amplitude of the signal applied to the negative input of the comparator switch 62. For example, with increasing values of the control signals applied to the duty cycle oscillator 42, the duty cycle approaches zero and with decreasing values of the control signals, the duty cycle approaches 100%.

The output of the duty cycle oscillator 42 is coupled to a controller in the carburetor 12 to effect adjustment of both the idle and main fuel metering circuits in accord with the magnitude of the control signal. A low duty cycle output of duty cycle oscillator 42 provides for an enrichment of the mixture supplied by the carburetor 12, while a high duty cycle is effective to provide a lean air/fuel ratio.

An example of a carburetor 12 and a controller responsive to a duty cycle signal for effecting adjustment of the mixture supplied by the idle and main fuel metering circuits of the carburetor 12 is illustrated in the U.S. patent applications Ser. No. 868,713, filed Jan. 11, 1978, and Ser. No. 869,454, filed Jan. 16, 1978, both of which are assigned to the assignee of this invention. In these applications, the duty cycle modulated control signal is applied to a solenoid which simultaneously adjusts elements in the idle and main fuel metering circuits to provide for air/fuel ratio adjustments. Consequently, when the engine is operating at idle and the carburetor idle fuel metering circuit is functioning to control the air/fuel mixture, the output of the duty cycle oscillator functions to adjust the air/fuel ratio provided by the idle fuel metering circuit. Conversely, when the vehicle is operating off-idle, the duty cycle signal is effective to provide for adjustment of the main fuel metering circuit to provide for air/fuel ratio control.

When a power enrichment mode is commanded, the control signal input to the duty cycle oscillator 42 is provided by the enrichment control circuit 34 whose output is coupled to the duty cycle oscillator 42 through a normally open switch 66 which is energized by the enrichment mode command signal ENR when the wide open throttle switch 30 is closed. The normally open switch 66 and the additional normally open switches hereinafter referred to may take any desired form of switch that is closed during the application of a positive voltage signal to a control input thereof.

The output of the power enrichment control circuit 34 is a control signal having a high value resulting in a low duty cycle output of the duty cycle oscillator 42. Consequently, during the power enrichment mode commanded by the enrichment signal ENR, the carburetor is commanded to provide a rich air/fuel ratio to provide for power enrichment.

When an open loop mode is commanded by the signal OL, an open loop control signal generated by the open loop control circuit 36 is coupled to the duty cycle oscillator 42 through a normally open switch 68 which is energized by the open loop command signal OL. The open loop control signal has a value that is a predetermined function of input parameters including engine temperature and manifold absolute pressure as sensed by the coolant temperature sensor 26 and the manifold absolute pressure sensor 28. The output of the duty cycle oscillator 42 has a duty cycle in accord with the magnitude of the open loop control signal provided by the open loop control circuit 36 to provide open loop adjustment of the carburetor 12. For example, the open loop control circuit 36 may provide a signal that is at a high value decreasing with increasing temperature to provide cold run enrichment of the engine 10.

When the closed loop mode is commanded by the signal CL, a closed loop control signal output of the closed loop control circuit 38 is coupled to the duty cycle oscillator 42 through a normally open switch 70 which is energized by the closed loop mode command signal CL. The duty cycle output of the duty cycle oscillator 42 is varied in accord with the closed loop control signal output of the closed loop circuit 38 to adjust the carburetor 12 in amount and direction tending to produce a predetermined air/fuel ratio which, in this embodiment, is stoichiometry.

The closed loop control circuit 38 includes the air/fuel ratio sensor 18 whose output is coupled to the positive input of a comparator switch 72 through a filter comprised of a resistor 74 and a capacitor 76. A reference voltage REF3 is provided to the negative input of the comparator switch 72 having a value between the upper and lower saturation voltage levels of the air/fuel ratio sensor 18 and equal to the sensor voltage when the sensed air/fuel ratio of the exhaust gases is stoichiometry. The comparator switch 72 provides an output signal which shifts abruptly between a constant low voltage level when the output of the air/fuel sensor 18 represents an air/fuel ratio greater than stoichiometry (lean) and a constant high voltage level when the output of the air/fuel sensor 18 represents an air/fuel ratio less than stoichiometry (rich).

While in another embodiment the closed loop circuit 38 may employ only an integral controller, the present embodiment employs an integral plus proportional correction term which is in the form of a step plus ramp function generated in response to the two-level output of the comparator switch 72 and which is effective to control the average air/fuel ratio of the mixture supplied by the carburetor 12 to stoichiometry.

The proportional term is provided by an amplifier 77 and its associated circuitry. The output of the comparator switch 72 is applied to the negative input of the amplifier 77 through a resistor 78. This voltage is compared with a reference voltage REF4 which has a value intermediate the high and low voltage output levels of the comparator switch 72. A gain setting resistor 80 is coupled between the output and negative input of the amplifier 77.

The integral correction term hereinafter referred to as INT is provided by a closed loop integrator 81 comprised of an operational amplifier 82 having a feedback capacitor 84. The output of the comparator switch 72 is coupled to the negative input of the amplifier 82 through a resistor 86. A reference voltage REF5 having a value intermediate the high and low outputs of the comparator switch 72 is coupled to the positive input of the amplifier 82. When the output of the comparator switch 72 is at the upper voltage level during the period when the sensed air/fuel ratio is rich, the integral term output of the closed loop integrator 81 decreases with a constant slope. When the voltage output of the comparator switch 72 is at the low voltage level when the sensed air/fuel ratio is lean, the integral term increases with a constant slope.

The proportional plus integral correction terms are summed by a summer 88 which provides a net closed loop correction term that is coupled to the duty cycle oscillator 42 through the normally open switch 70 during operation of the electronic control unit 20 in a closed loop mode. In general, the duty cycle output of the duty cycle oscillator 42 may, for illustrative purposes, vary between 5% and 95%, an increasing duty cycle effecting a decreasing fuel flow to increase the air/fuel ratio and a decreasing duty cycle effecting an increase in the fuel flow to decrease the air/fuel ratio. The range of duty cycle from 5% to 95% may represent a change in four air/fuel ratios at the carburetor 12. The gain of the closed loop integrator 81 may be selected so that the integral term varies the duty cycle output of the duty cycle oscillator 42 at a rate producing 0.9 air/fuel ratios per second adjustment of the carburetor 12. While not illustrated, the integral term may be limited to provide for the minimum and maximum duty cycle control values by limiter circuits. For example, the lean limit may be limited to 95% during normal warm operation but varied to lower duty cycle values as a function of cold engine operation and the rich limit may be limited normally at 5% and varied during hot engine operation to higher duty cycle values.

When the electronic control unit 20 operation shifts from the closed loop mode to the enrichment mode and then returns to the closed loop mode, the carburetor 12 adjustment is initialized to the adjustment provided by the closed loop control circuit 38 at the time of the shift to the power enrichment mode. This is accomplished by a normally open switch 89 which is energized by the enrichment mode control signal ENR to couple the reference signal REF5 to the negative input of the integrator 81. During the period of the signal ENR, the integrator 81 output is frozen and remains constant. Upon termination of the signal ENR, the switch 89 opens and the integrator 81 output varies from this value in accord with the output of the sensor 18.

A characteristic of the system is the transport delay involved in the induction, combustion and exhaust processes. The engine 10 receives the air/fuel mixture from the carburetor 12 through the intake manifold, burns the mixture, and passes it down the exhaust manifold past the exhaust sensor 18 and through the catalytic converter 16. Changes in the air/fuel mixture generated by carburetor error, distribution characteristics of the engine 10 and the intake system, and transient effects due to fuel variations through the engine 10 can be observed by the sensor 18 only after the transport time delay. Therefore, the engine has gone rich or lean sometime before the sensor sees the error. After the error is sensed, additional time is required for the closed loop control circuit 38 to effect a correction. As a result of these delays, the proportional plus integral terms cause the air/fuel ratio of the mixture supplied by the carburetor 12 to overshoot the stoichiometric ratio by an amount determined by the transport delay, the magnitude of the proportional step and the rate of change of the integral term of the control signal. Consequently, the system limits cycles with the amplitude and frequency of the oscillation of the limit cycle being determined by the time constant of the system and the transport delay.

Without the adaptive circuit 40 to be hereinafter described, if an air/fuel ratio offset exists between the idle and main fuel metering circuits of the carburetor 12, an air/fuel ratio offset from the stoichiometric value would exist for a time period after the carburetor operation shifts between the idle and main metering circuits. This offset may result in a decrease in the efficiency of the converter 16 relative to at least one of the exhaust gas constituents thereby resulting in an increase in undesirable emissions. For example, when the carburetor shifts between its main and idle fuel metering circuits, the air/fuel ratio shifts substantially instantaneously in accord with the offset between the two fuel metering circuits. The closed loop control circuit 38 responds to this offset in air/fuel ratio from the stoichiometric value where the carburetor was previously adjusted only after the engine transport delay time has lapsed. Thereafter, the controller 38 can adjust the mixture again to the stoichiometric value only after a time period dependent upon the magnitude of the proportional step and the rate of change of the integral term. After these two time periods, the closed loop controller 38 is then effective to maintain the mixture at a stoichiometric value. The adaptive circuit 40 operates in accord with the principles of this invention to substantially eliminate the time required for the closed loop control circuit 38 to adjust to the shift in the air/fuel ratio resulting when the carburetor 12 shifts in operation between its idle and main fuel metering circuits and when there is an air/fuel ratio offset between the two fuel metering circuits. In this manner, a decrease in converter conversion efficiency and resulting increase in exhaust emissions is avoided.

The adaptive control circuit 40 in general functions to track the average value of the output of the closed loop control circuit 38 during operation of each of the idle and main fuel metering circuits of the carburetor 12 only during the vehicle engine operating conditions where the sensed air/fuel ratio is indicative of the actual air/fuel ratio of the mixture supplied by the respective idle or main fuel metering circuit. This average value of the closed loop control output signal is indicative of the required adjustment of the respective fuel metering circuit to provide a stoichiometric mixture.

When the engine operation shifts from idle to off-idle resulting in the operation of the carburetor 12 shifting from the idle fuel metering circuit to the main fuel metering circuit, the value of the closed loop control signal required to adjust the idle fuel metering circuit to obtain a stoichiometric mixture is retained in an idle memory. When the operation of the carburetor 12 again returns to the idle fuel metering circuit, the closed loop control signal is preset to the stored value in the idle fuel memory. Since this value was determined by the closed loop control circuit 38 during prior operation of the idle fuel metering circuit to be required to adjust the idle fuel metering circuit to produce a stoichiometric air/fuel ratio, the idle fuel metering circuit is substantially instantaneously preset to an adjustment producing a stoichiometric air/fuel ratio. The closed loop control circuit 28 thereafter functions in the normal manner to maintain the air/fuel mixture at an average value of stoichiometry. Similarly, the average value of the closed loop control signal output of the closed loop control circuit 38 during operation of the main fuel metering circuit of the carburetor 12 is stored in a main memory when the operation of the carburetor 12 shifts to its idle fuel metering circuit. The integral control term output of the closed loop integrator in the closed loop control circuit 38 is then preset to this value when the operation of the carburetor 12 again returns to the main fuel metering circuit so that the main fuel metering circuit is substantially instantaneously adjusted to provide a stoichiometric air/fuel ratio. Since the average value of the integral correction term INT is equal to the average value of the total closed loop correction term output of the summer 88, the signal INT will be used by the adaptive circuit 40 as representing the closed loop control signal value.

Operation of the carburetor idle or main fuel metering circuit during engine idle and off-idle operation, respectively, is detected by the normally open idle switch 24 referred to in FIG. 1 that is closed by the carburetor throttle operator when the throttle blades in the carburetor 12 are moved to a closed position. Engine idle operation during which the idle fuel metering circuit is operational is represented by a closed switch 24 and engine off-idle operation during which the main fuel metering circuit is operational is represented by an open switch 24. Alternatively, other means such as engine manifold pressure may be used to detect operation of the fuel metering circuits.

The switch 24 is series coupled with a resistor 90 between ground potential and the voltage source V. When the switch 24 is open during engine off-idle operation, logic 1 level signal $\overline{CT}$ is provided representing operation of the main fuel metering circuit. When the switch 24 is closed during engine idle operation, a logic 1 signal CT is provided at the output of an inverter 92 representing operation of the idle fuel metering circuit. Upon the transition from the idle fuel metering circuit to the main fuel metering circuit, a single shot multivibrator 94 is energized to provide a short duration logic 1 pulse $\overline{CT}'$, and upon a transition from the main fuel metering circuit to the idle fuel metering circuit, a single shot multivibrator 96 is energized to provide a logic 1 pulse CT'.

The memory circuit associated with the idle fuel metering circuit operation includes an idle memory integrator 100 comprised of an amplifier 102 having a feedback capacitor 104. A reference voltage REF6 is applied to the positive input of the idle memory integrator 100 through a resistor 106. When the conditions exist wherein the air/fuel ratio sensed by the air/fuel sensor 18 is indicative of the air/fuel ratio of the mixture supplied by the idle fuel metering circuit, a signal is provided to the negative input of the idle memory integrator 100 through a normally open switch 108 and a resistor 110 representing the sense of deviation of the output of the idle memory integrator from the closed loop integral term INT. This signal is provided by a comparator switch 112 having the output of the idle memory integrator 100 supplied to its positive input and the closed loop integral term INT supplied to its negative input and whose output is coupled to the normally open switch 108.

The output of the comparator switch 112 is greater than or less than the reference value REF6 depending on the sense of error of the output of the idle memory integrator 100 relative to the closed loop integral control term INT and the direction of integration of the idle memory integrator 100 is in a sense tending to reduce the error to zero. The time constant of the idle memory integrator 100 is such that the output thereof assumes a value that tracks substantially the average of the integral term INT which represents the average value of the closed loop control signal from the closed loop control circuit 38.

When the conditions representing that the sensed air/fuel ratio is indicative of the air/fuel ratio of the mixture supplied by the idle fuel metering circuit do not exist, the reference voltage REF6 is applied to the negative input of the idle memory integrator 100 through a normally open switch 114 and the resistor 110. Since both inputs are then equal, the idle memory integrator 100 ceases integrating and effectively memorizes or stores its output value.

This invention recognizes that an engine operating condition exists where the air/fuel ratio sensed by the air/fuel sensor 18 may not be indicative of the actual air/fuel ratio of the mixture supplied by the idle metering circuit. This condition exists when the throttle is closed effecting operation of the idle fuel metering circuit and the engine speed is greater than a value such as 800 rpm. This condition may result in an air/fuel ratio being sensed by the air/fuel sensor 18 different from the air/fuel ratio of the mixture supplied by the idle fuel metering circuit as a result of, for example, the vaporization of fuel from the carburetor and manifold walls during the high vacuum condition. This invention therefore energizes the normally open switch 108 to cause the idle memory integrator 100 to track or be updated to the average value of the closed loop control signal only when the idle fuel metering circuit is operating and the engine speed is below a predetermined value such as 800 rpm and energizes the normally open switch 114 to cause the integrator to store the average value of the closed loop control signal from the closed loop circuit 38 during all other engine operating conditions. This is accomplished by a logic AND gate 116 which receives the signal CT representing operation of the idle fuel metering circuit and the output from a comparator switch 118 which is a logic 1 level when the engine speed is below the predetermined value and a logic 0 level when the engine speed is greater than the predetermined value. In this respect, the comparator switch 118 compares the engine rpm with a reference signal REF7 having a value representing the predetermined engine speed.

When both inputs of the AND gate 116 are logic 1 levels, its output is a logic 1 level which energizes the normally open switch 108 to enable the idle memory integrator 100 to be updated to the average value of the integral term INT and consequently the closed loop control signal. When either input to the AND gate 116 shifts to a logic 0 level, its output shifts to a logic 0 level to cause the output of an inverter 120 to shift to a logic 1 level which energizes the normally open switch 114 to cause the idle memory integrator 100 to store the existing average value of the closed loop control signal. This average value is the value required to adjust the idle fuel metering circuit of the carburetor 12 to produce a stoichiometric air/fuel ratio.

Similarly, the adaptive control circuit 40 includes a main memory integrator 122 comprised of an amplifier 124 with a feedback capacitor 126. A reference voltage REF8 is applied to the positive input of the main memory integrator 122 through a resistor 128. When the conditions exist wherein the air/fuel ratio sensed by the air/fuel sensor 18 is indicative of the air/fuel ratio of the mixture supplied by the main fuel metering circuit, a signal is provided to the negative input of the main memory integrator 122 through a normally open switch 130 and a resistor 132 representing the sense of deviation of the output of the main memory integrator 122 from the closed loop integral term INT. This signal is provided by a comparator switch 134 having the output of the main memory integrator 122 supplied to its positive input and the closed loop integral term INT supplied to its negative input and whose output is coupled to the normally open switch 130.

The output of the comparator switch 134 is greater than or less than the reference signal REF8 depending on the sense of the error of the output of the main memory integrator 122 relative to the closed loop integral term INT and the direction of integration of the main memory integrator 122 is in a sense tending to reduce the error to zero. The time constant of the main memory integrator 122 is such that the output thereof assumes a value that tracks substantially the average of the integral term INT and consequently the average value of the closed loop control signal from the closed loop control circuit 38.

When the conditions representing that the sensed air/fuel ratio is indicative of the air/fuel ratio of the mixture supplied by the main fuel metering circuit do not exist, the reference voltage REF8 is applied to the negative input of the main memory integrator 122 through a normally open switch 136 and the resistor 132. Since both inputs are then equal, the main memory integrator 122 stops integrating and effectively memorizes or stores its output value.

As previously described with respect to the idle memory integrator 100, this invention recognizes that an engine operating condition exists where the air/fuel ratio sensed by the sensor 18 may not be indicative of the actual air/fuel ratio of the mixture supplied by the main fuel metering circuit. This condition exists when the throttle is opened effecting operation of the main fuel metering circuit and the engine speed is less than the predetermined low value referred to with respect to the operation of the idle fuel metering circuit. This condition may result in an air/fuel ratio being sensed by the sensor 18 different from the air/fuel ratio supplied by the main fuel metering circuit as a result of the fuel wetting carburetor and manifold walls upon the opening of the throttle while the engine speed is low. This invention therefore energizes the normally open switch 130 to cause the main memory integrator 122 to track or be updated to the average value of the closed loop control signal only when the main fuel metering circuit is operating and the engine speed is greater than the predetermined value and energizes the normally open switch 136 to cause the main memory integrator 122 to store the average value of the closed loop control signal during all other engine operating conditions. This is accomplished by an AND gate 138 which receives the signal $\overline{CT}$ representing operation of the main fuel metering circuit, the signal $\overline{ENR}$ indicating that the electronic control unit 20 is not operating in an enrichment mode and the inverse of the output of the comparator switch 118 as provided by an inverter 140 and which is a logic 1 level when the engine speed is greater than the reference speed represented by the signal REF7.

When all of the inputs to the AND gate 138 are logic 1 levels, its output is a logic 1 level which energizes the normally open switch 130 to enable the main memory integrator 122 to be updated to the average value of the closed loop control signal as represented by the average value of the integral term INT. When any one of the inputs to the AND gate 138 shifts to a logic 0 level, the output thereof shifts a logic 0 level to cause the output of an inverter 141 to shift to a logic 1 level to energize the normally open switch 136. The main memory integrator 122 then stores its output representing the closed loop control signal required to adjust the main fuel metering circuit to produce a stoichiometric air/fuel ratio.

When the engine operation is operating in an off-idle mode wherein the main fuel metering circuit is operational, and thereafter shifts to an idle mode wherein the idle fuel metering circuit becomes operational, the integral control term INT provided by the integrator 81 in the closed loop circuit 38 is preset to the value stored by the idle memory integrator 100 which represents the previously determined idle fuel metering adjustment required to obtain a stoichiometric air/fuel ratio. This is accomplished by means of an idle preset integrator 142 comprised of an amplifier 144 and a feedback capacitor 146. The closed loop control signal value stored by the idle memory circuit 100 is coupled to the negative input of the preset integrator 142 and the integral control term INT output of the integrator 81 in the closed loop circuit 38 is coupled directly to its positive input. When the operation of the carburetor 12 shifts from its main fuel metering circuit to its idle fuel metering circuit, the signal CT' closes a normally open switch 148 which couples the output of the idle preset integrator 142 directly to the negative input of the closed loop integrator 81. The idle preset integrator 142 substantially instantaneously presets the closed loop integrator 81 to the value of the closed loop control signal stored by the idle memory integrator 100. Upon termination of the signal CT', the normally open switch 148 opens and the closed loop control circuit 38 functions to control the idle fuel metering circuit in accord with the sensed air/fuel ratio.

Similarly, when the engine 10 is operating in an idle mode wherein the idle fuel metering circuit is operational and thereafter shifts to off-idle operation wherein the main fuel metering circuit is operational, the integral control term INT at the output of the closed loop integrator 81 is preset to the value of the closed loop control signal stored by the main memory integrator 122 which represents the previously determined main fuel metering adjustment required to obtan a stoichiometric air/fuel ratio. This is accomplished by means of a main preset integrator 150 including an amplifier 152 and a feedback capacitor 154. The value of the closed loop control signal stored by the main memory integrator 122 is coupled to the negative input of the main preset integrator 150 and the integral control term INT is coupled to the positive input thereof. When the operation of the carburetor 12 shifts from its idle fuel metering circuit to its main fuel metering circuit, the signal $\overline{CT}'$ closes a normally open switch 156 to couple the output of the main preset integrator 150 directly to the negative input of the closed loop integrator 81. The main preset integrator 150 substantially instantaneously presets the integral term INT output of the closed loop integrator 81 to the value of the closed loop control signal stored by the main memory integrator 122. Upon termination of the signal $\overline{CT}'$ the normally open switch 156 opens and the closed loop control circuit 38 functions to control the main fuel metering circuit in accord with the sensed air/fuel ratio.

The foregoing adaptive control circuit 40 eliminates the time required for the closed loop circuit 38 to adjust for the offset between the idle and main fuel metering circuits upon a transition between the fuel metering circuits. Consequently, an increase in the emission of undesirable exhaust gas constituents is avoided. Furthermore, in accord with the principles of this invention, the value of the closed loop control signal that is memorized more closely represents the value of the closed loop control signal required to adjust either the main or idle metering circuit to a stoichiometric value by inhibiting the updating of the respective memory circuits during engine operating conditions where the sensed air/fuel ratio is not truly indicative of the air/fuel ratio supplied by the respective fuel metering circuits.

While the invention has been described with respect to a specific circuit, it is contemplated that the invention could be embodied in a digital computer wherein the digital computer provides for closed loop operation of the fuel metering circuits and wherein the computer includes a pair of memory locations each corresponding to a respective one of the idle and main fuel metering circuits with the memory locations being updated in accord with the output of the closed loop controller during those time periods when the sensed engine speed is less than a predetermined value during operation of the idle fuel metering circuit and when the engine speed is greater than a predetermined value during operation of the main fuel metering circuit. The values in these memories are then utilized to initialize the closed loop adjustment value when the engine operation shifts between idle and off-idle.

The foregoing description of the invention for purposes of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. An adaptive closed loop air and fuel mixture control system for an engine, comprising, in combination:

a carburetor effective to supply a mixture of air and fuel to the engine, said carburetor having idle and main fuel metering circuits operable to supply fuel to the engine during engine idle and off-idle operating modes, respectively;

a sensor effective to monitor the oxidizing/reducing conditions of the air and fuel mixture and provide a sensor signal indicating at least the sense of deviation of the oxidizing/reducing conditions from a desired condition;

an air/fuel ratio controller responsive to the sensor signal effective during both engine idle and off-idle operating modes to adjust the air/fuel ratio of the mixture supplied by the carburetor, the controller providing an output signal including an integral term effective to adjust the air/fuel ratio at a predetermined rate to an amount producing substantially the desired oxidizing/reducing condition;

means effective to sense the idle and off-idle operating modes of the engine;

means effective to sense engine speed;

first and second storage means effective to store values of the controller output signal, each storage means being associated with a respective one of the idle and off-idle operating modes of the engine;

means effective to adjust the value of the controller output signal stored by the storage means associated with the sensed operating mode to the average value of the controller output signal;

means effective to inhibit the last-mentioned means from adjusting the value of the controller output signal stored by the first and second storage means when [1] the engine idle operating mode is sensed and the sensed engine speed is greater than a predetermined value and [2] the engine off-idle operating mode is sensed and the sensed engine speed is less than the predetermined value; and means responsive to a shift in the engine operation from one of said engine operating modes to the other of said engine operating modes to preset the value of a controller output signal to the average value of the output signal stored by the storage means associated with said other engine operating mode to thereby preset the controller output signal substantially instantaneously to the value previously determined by the controller during operation in said other operating mode to produce the desired oxidizing/reducing condition.

2. An adaptive closed loop air and fuel mixture control system for an engine, comprising, in combination:

a carburetor effective to supply a mixture of air and fuel to the engine, said carburetor having idle and main fuel metering circuits operable to supply fuel to the engine during engine idle and off-idle operating modes, respectively;

a sensor effective to monitor the oxidizing/reducing conditions of the air and fuel mixture and provide a sensor signal indicating at least the sense of deviation of the oxidizing/reducing conditions from a desired condition;

an air/fuel ratio controller responsive to the sensor signal effective during both engine idle and off-idle operating modes to adjust the air/fuel ratio of the mixture supplied by the carburetor, the controller providing an output signal including an integral term effective to adjust the air/fuel ratio at a predetermined rate to an amount producing substantially the desired oxidizing/reducing condition;

means effective to sense the idle and off-idle operating modes of the engine;

means effective to sense engine speed;

means effective during engine operation in each one of the engine idle and off-idle operating modes to track the average value of the controller output signal and store said average value when the engine operating mode shifts to the other one of the operating modes;

means effective to inhibit the last-mentioned means when [1] the engine idle operating mode is sensed and the sensed engine speed is greater than a predetermined value and [2] the engine off-idle operating mode is sensed and the sensed engine speed is less than the predetermined value; and means responsive to a shift in the engine operation from one of said engine operating modes to the other of said engine operating modes to preset the value of the controller output signal to the stored average value that produced the desired oxidizing/reducing condition during prior engine operation in said other engine operating mode, wherein the preset value substantially instantaneously adjusts the air/fuel ratio of the mixture supplied by the carburetor to the value previously determined by the controller during operation in said other operating mode to produce the desired oxidizing/reducing condition.

* * * * *